US011633705B2

(12) United States Patent
Rogers

(10) Patent No.: US 11,633,705 B2
(45) Date of Patent: Apr. 25, 2023

(54) AGITATORS, STORAGE VESSEL ASSEMBLIES, AND METHODS OF AGITATING DRY PARTICULATES WITHIN STORAGE VESSEL ASSEMBLIES

(71) Applicant: Kidde Technologies, Inc., Wilson, NC (US)

(72) Inventor: Aaron Stanley Rogers, Surf City, NC (US)

(73) Assignee: KIDDE TECHNOLOGIES, INC., Wilson, NC (US)

( * ) Notice: Subject to any disclaimer, the term of this patent is extended or adjusted under 35 U.S.C. 154(b) by 513 days.

(21) Appl. No.: 16/674,846

(22) Filed: Nov. 5, 2019

(65) Prior Publication Data

US 2021/0129095 A1 May 6, 2021

(51) Int. Cl.

| | |
|---|---|
| ***B01F 13/00*** | (2006.01) |
| ***A62C 13/76*** | (2006.01) |
| ***A62C 13/00*** | (2006.01) |
| ***B01F 15/00*** | (2006.01) |
| ***B01F 33/25*** | (2022.01) |
| ***B01F 33/501*** | (2022.01) |
| ***B01F 35/32*** | (2022.01) |

(52) U.S. Cl.

CPC ..... *B01F 33/25* (2022.01); *A62C 13/006* (2013.01); *A62C 13/76* (2013.01); *B01F 33/50111* (2022.01); *B01F 35/3202* (2022.01)

(58) Field of Classification Search

CPC ..... B01F 33/25; B01F 33/50111; A47J 43/27

See application file for complete search history.

(56) References Cited

U.S. PATENT DOCUMENTS

| | | | | |
|---|---|---|---|---|
| 674,827 | A | 5/1901 | Edmands | |
| 4,641,974 | A * | 2/1987 | Church | B01F 33/25 366/342 |
| D532,113 | S | 11/2006 | Huang | |
| 9,538,884 | B2 * | 1/2017 | Avila | B01F 35/32021 |
| 2008/0053667 | A1 | 3/2008 | Rousseau et al. | |
| 2013/0213675 | A1 | 8/2013 | Rousseau et al. | |
| 2014/0340979 | A1 * | 11/2014 | Keel, III | B01F 35/32021 366/343 |
| 2016/0038893 | A1 | 2/2016 | Johns | |
| 2018/0056256 | A1 * | 3/2018 | Sun | B01F 33/25 |

FOREIGN PATENT DOCUMENTS

| | | | |
|---|---|---|---|
| EP | 2664362 | A2 | 11/2013 |
| KR | 20130122852 | A | 11/2013 |
| WO | 2010140796 | A2 | 12/2010 |

OTHER PUBLICATIONS

Extended European Search Report; International Application No. 20205682.6-1017; International Filing Date: Nov. 4, 2020; dated Mar. 22, 2021; 9 pages.

European Office Action for European Application No. 20 205 682.6; Report dated Nov. 30, 2022 (pp. 1-4).

* cited by examiner

*Primary Examiner* — Elizabeth Insler

(74) *Attorney, Agent, or Firm* — Cantor Colburn LLP

(57) ABSTRACT

An agitator for disposition within a cavity of a vessel body containing a particulate includes a weighted portion and a stirring portion. The agitator is positioned and disposed relative to the vessel body to move the stirring portion through the particulate in response to movement of the weighted portion in response to gravitational and/or inertial forces acting on the weighted portion due to movement of the vessel body. Particulate storage vessel arrangements and methods of particulate mixing are also described.

13 Claims, 4 Drawing Sheets

AGITATORS, STORAGE VESSEL ASSEMBLIES, AND METHODS OF AGITATING DRY PARTICULATES WITHIN STORAGE VESSEL ASSEMBLIES

BACKGROUND

The present disclosure is generally related to dry particulate storage, and more particularly to maintaining mobility of dry particulates contained within storage vessels such as in fire suppression systems on aircraft.

Dry particulate, such as fire suppressant chemicals, are commonly stored with the confines of storage vessels until required or the storage vessel serviced. When required the dry particulate is generally conveyed out of the storage vessel by a motive gas flow, which carries the particulate out of the storage vessel and into the environment external of the storage vessel. The amount of motive gas required to carry the dry particulate from the storage vessel typically corresponds to the ability of the motive gas to fluidize the dry particulate, with packed dry particulates tending to resist fluidization by the motive gas and loose dry particulates tending to more readily fluidize with the motive gas.

In some storage vessels dry particulate can pack within the storage vessel. For example, some dry particulates can pack against the interior surface of the storage vessel during charging as the gas drives the dry particulate into the storage vessel. Some dry particulates can also settle over time due to the effects of gravity. Contaminants within the storage vessel, such as moisture, can also cause some dry particulates to pack within the storage vessel. For these reasons some storage vessels such as fire suppression cylinders require cyclic inspection, cyclic refurbishment, periodic replacement, and/or mechanized or motorized mixing elements requiring external power to ensure availability of the system employing the storage vessel.

Such systems and methods have generally been acceptable for their intended purpose. However, there remains a need in the art for improved agitators, pressure vessel assemblies having agitators, and methods of mixing dry particulates inhabiting pressure vessels.

BRIEF DESCRIPTION

An agitator is provided. The agitator includes a rod member defining an axis, a tine member, and a flip member. The tine member extends radially from the axis and has a base portion and a tip portion, the base portion connecting the tip portion to the rod member. The flip member has a rod portion and a weighted ball portion, the rod portion connecting the weighted ball portion with the rod member at a location radially offset from the tip portion of the tine member to flip the agitator end over end responsive to force applied to the weighted ball portion of the flip member.

In addition to one or more of the features described above, or as an alternative, further embodiments of the agitator may include that the rod member connects the tine member to the flip member, the flip member axially offset from the tine member.

In addition to one or more of the features described above, or as an alternative, further embodiments of the agitator may include that the rod member is a first rod member and further comprising at least one second rod member, the second rod member arranged along the axis and connected to the first rod member by the tine member.

In addition to one or more of the features described above, or as an alternative, further embodiments of the agitator may include that the tine member is a first tine member and that the agitator additionally includes a second tine member, the second tine member connected to the rod member.

In addition to one or more of the features described above, or as an alternative, further embodiments of the agitator may include that the second tine member is coplanar with the first tine member.

In addition to one or more of the features described above, or as an alternative, further embodiments of the agitator may include that the second tine member is arranged in a plane orthogonal relative to the first tine member.

In addition to one or more of the features described above, or as an alternative, further embodiments of the agitator may include that the flip member is a first flip member and that the agitator additionally includes a second flip member connected to the rod member.

In addition to one or more of the features described above, or as an alternative, further embodiments of the agitator may include that the first flip member and the tine member are arranged in a common plane.

In addition to one or more of the features described above, or as an alternative, further embodiments of the agitator may include that the second flip member is offset from the first flip member 90-degrees or 180-degrees.

In addition to one or more of the features described above, or as an alternative, further embodiments of the agitator may include that the first flip member and the second flip member are arranged on an axially common side of the tine member.

In addition to one or more of the features described above, or as an alternative, further embodiments of the agitator may include that the first flip member and the second flip member are arranged on axially opposite sides of the tine member.

In addition to one or more of the features described above, or as an alternative, further embodiments of the agitator may include that the flip member is one of a two or more of flip members, that the two or more flip members evenly distributed between axially opposite ends of the agitator, that the two or more flip members are evenly distributed about the axis, and that the two or more flip members are unevenly distributed about the axis at the axially opposite ends of the agitator.

In addition to one or more of the features described above, or as an alternative, further embodiments of the agitator may include that the agitator is formed from a polymeric or a metallic material.

In addition to one or more of the features described above, or as an alternative, further embodiments of the agitator may include that the rod member is one of two or more rod members axially spaced from one another along the axis, that the tine member is one of two or more tine members connected to the rod members, and that the flip member is one of two or more flip members circumferentially offset from one another about the axis.

A particulate storage vessel arrangement is also provided. The storage vessel includes a vessel body with a wall bounding a cavity of the vessel body and an agitator as described above. The agitator is disposed within the cavity of the vessel body in a metastable support arrangement and the wall of the vessel body defines a movement envelope of the agitator.

In addition to one or more of the features described above, or as an alternative, further embodiments of the particulate storage vessel arrangement may include a fire suppressant dry particulate disposed within the in the cavity of the vessel body and in mechanical communication with the agitator, the agitator formed from a polymeric or a metallic material that cooperates with the weighted ball portion to limit damage to the wall of the vessel body and within the movement envelope of the agitator.

A method of agitating a dry particulate is additionally provided. The method includes, at an agitator as described above, exerting force against the weighted ball portion of the flip member, and flipping and/or spinning the agitator end-over-end with the force exerted on the weighted ball portion of the flip member.

In addition to one or more of the features described above, or as an alternative, further embodiments of the method may include that exerting the force against the weighted ball portion of the member entails flowing a charging flow of fire suppressant dry particulate across the weighted ball portion to exert the force on the agitator; the method further including mixing the fire suppressant dry particulate with the tine member during the flipping and/or spinning of the agitator.

In addition to one or more of the features described above, or as an alternative, further embodiments of the method may include that exerting the force against the weighted ball portion of the member includes flowing a discharge flow of fire suppressant dry particulate across the weighted ball portion to exert the force on the agitator; the method further including mixing the fire suppressant dry particulate with the tine member during the flipping and/or spinning of the agitator.

In addition to one or more of the features described above, or as an alternative, further embodiments of the method may include that a fire suppressant dry particulate is in mechanical communication with the agitator, the method further including vibrating the agitator to exert the force on the agitator and mixing the fire suppressant dry particulate with the tine member during the flipping and/or spinning of the agitator.

Technical effects of the present disclosure include the capability to agitate dry particulates within pressure vessels. In certain examples technical effects of the present disclosure include enabling a dry particulate contained within a sealed storage vessel to be passively mixed, such as by vibrational forces consequential to the pressure vessel being carried by a vehicle. In accordance with certain examples technical effects of the present disclosure include enabling the dry particulate to be mixed, via internal agitation, collateral with introduction into the pressure vessel. It is also contemplated that, in certain examples, that the present disclosure provide dry particulate mixing, via internal agitation, collateral with discharge of the dry particulate from the pressure vessel.

BRIEF DESCRIPTION OF THE DRAWINGS

The following descriptions should not be considered limiting in any way. With reference to the accompanying drawings, like elements are numbered alike.

DETAILED DESCRIPTION

Figure 1:
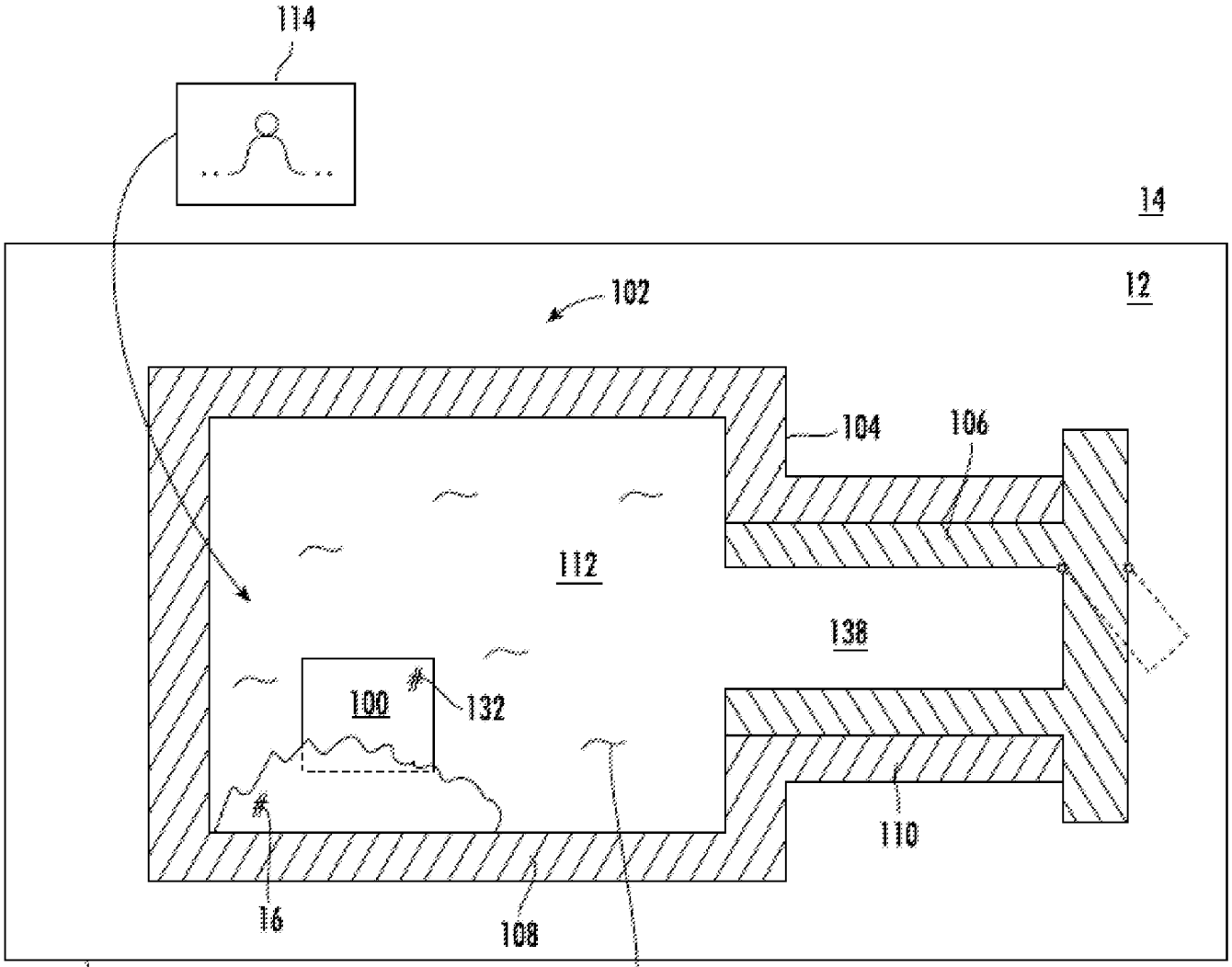
FIG. 1 is a schematic cross-section side view of a particulate storage vessel arrangement constructed in accordance with the present disclosure, showing an agitator contained within a particulate storage vessel arrangement and the particulate storage vessel arrangement carried by a vehicle-born fire suppression system.

Reference will now be made to the drawings wherein like reference numerals identify similar structural features or aspects of the subject disclosure. For purposes of explanation and illustration, and not limitation, a partial view of an example implementation of an agitator constructed in accordance with the disclosure is shown in FIG. 1 and is designated generally by reference character 100. Other embodiments of agitators, storage vessels having agitators, and methods of agitating dry particulate contained within storage vessels in accordance with the present disclosure, or aspects thereof, are provided in FIGS. 2-6, as will be described. The systems and methods described herein can be used for agitating dry particulate contained within storage vessels, such as dry fire suppressant chemical mixtures in vehicle-borne fire suppressant systems, though the present disclosure is not limited to fire-suppressant systems or to vehicle-borne fire suppression systems in general.

Referring to FIG. 1, a vehicle 10, e.g., an aircraft, is shown. The vehicle 10 includes a fire suppression system 12 having a particulate storage vessel arrangement 102. In the illustrated example the particulate storage vessel arrangement 102 is a pressure vessel assembly and includes a vessel body 104, the agitator 100, and a valve 106. The vessel body 104 includes a wall 108 and has a boss 110. The wall 108 bounds a cavity 112 of the vessel body 104. The boss 110 extends from the vessel body 104 and defines a port 138. The port 138 is in communication with the cavity 112 of the vessel body 104 and seats therein the valve 106.

The valve 106 provides selective fluid communication between the environment 14 external to the particulate storage vessel arrangement 102. In this respect the valve 106 provides fluid communication between the external environment, e.g., a source of fire suppressant dry particulate 16 and/or a source of a motive gas 18, for charging the particulate storage vessel arrangement 102 (shown in FIG. 4). It is also contemplated that the valve 106 has an actuated state for issuing the fire suppressant dry particulate 16 in cooperation with the motive gas 18 during discharge of the particulate storage vessel arrangement 102 (shown in FIG. 5). The valve 106 also provides sealing (e.g., hermetic sealing) of the cavity 112 from the external environment 14 between charging and discharging of the particulate storage vessel arrangement 102 (shown in FIG. 5).

The fire suppressant dry particulate 16 and the agitator 100 are contained within the cavity 112 of the vessel body 104. In this respect both the fire suppressant dry particulate 16 and the agitator 100 freely disposed within the cavity 112 of the vessel body 104, the cavity 112 of the vessel body 104 defining a movement envelop of the agitator 100. In certain examples the fire suppressant dry particulate 14 includes a singular fire suppressant chemical. In accordance with certain examples the fire suppressant dry particulate 16 includes a mixture of compositions, e.g., one or more a fire suppressant chemical dry particulate mixed with a fluidizer dry particulate to facilitate issue of the one or more fire suppressant dry particulate through the valve 106. Examples of suitable fire suppressant dry particulates include monoammonium phosphate, sodium bicarbonate, and potassium bicarbonate. It is also contemplated that, in accordance with certain examples, that the motive gas 18 contained within the cavity 112 of the vessel body 104 be in communication with the fire suppressant dry particulate 16 for issuing the fire suppressant dry particulate 16 from the vessel body 104. Examples of suitable motive gases include nitrogen and carbon dioxide.

As will be appreciated by those of skill in the art in view of the present disclosure, dry particulates contained within storage vessels such as the fire suppressant dry particulate 16 contained within the vessel body 104 can be subject to packing—potentially limiting the reliability of such fire suppression assemblies. For example, introduction of fire suppressant dry particulates into some storage vessel bodies can cause the fire suppressant dry particulate to pack against cavity surfaces the vessel body. Further, fire suppressant dry particulates in some storage vessel bodies can also settle and pack progressively over time within the cavity of the vessel body over time, e.g., by operation of gravity. Fire suppressant dry particulates can also pack as a result of contaminants present within the storage vessel containing the particulate, such as from moisture infiltration through the particulate storage vessel arrangement valve and/or from residual oil remaining in the storage vessel and/or value from the manufacturing process. To limit (or eliminate entirely) packing of the fire suppressant dry particulate 14 the agitator 100 is supported within the cavity 112 of the vessel body 104 in a metastable support arrangement 114, i.e., an arrangement wherein the agitator moves responsive to the application of relatively small amounts of force, the metastable support arrangement 114 causing the agitator 100 to mix the fire suppressant dry particulate 14 in mechanical communication with the agitator 100.

Figure 2:
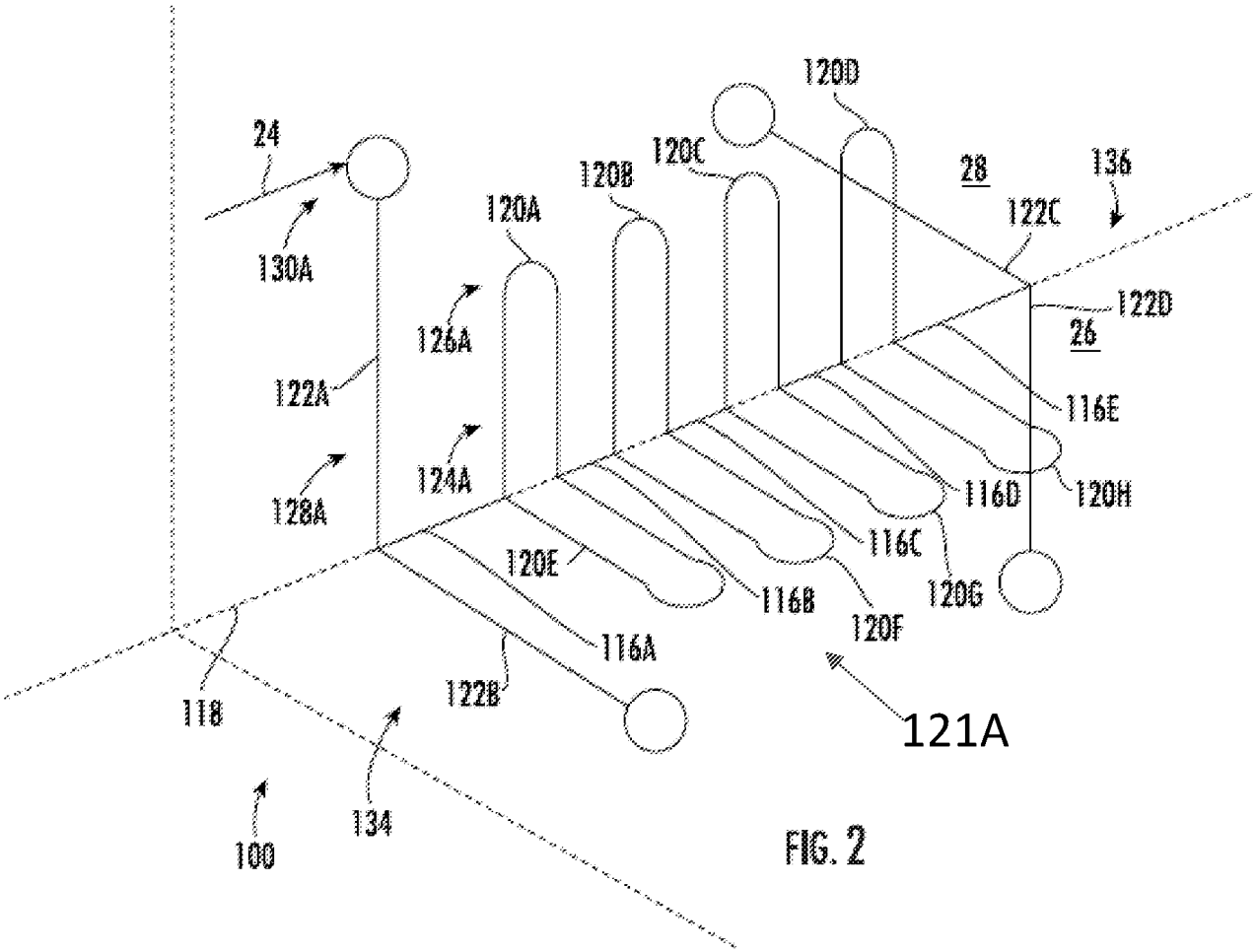
FIG. 2 is a perspective view of the agitator of FIG. 1 according to an example, showing a plurality of flip members with weighted ball portions connected to a plurality of tine members by a plurality of rod members.

With reference to FIG. 2, the agitator 100 is shown. The agitator 100 is arranged for disposition within the cavity 112 (shown in FIG. 1) of the vessel body 104 (shown in FIG. 1) containing a particulate, e.g., the dry particulate 16 (shown in FIG. 1), and includes a weighted portion 130A and a stirring portion 121A. It is contemplated that the agitator 100 be positioned and disposed relative to the vessel body 104 to move the stirring portion 121A through the particulate 16 in response to movement of the weighted portion 130A in response to gravitational and/or inertial forces, e.g., a force 24, acting on the weighted portion 130A due to movement of the vessel body 104.

In the illustrated example the agitator 100 includes a rod member 116A defining an axis 118, a tine member 120A, and a flip member 122A. The tine member 120A extends radially from the axis 118 and has a base portion 124A and a tip portion 126A, the base portion 124A connecting the tip portion 124A to the rod member 116A. The flip member 122A has a rod portion 128A and a weighted ball portion 130A, the rod portion 128A connecting the weighted ball portion 130A with the rod member 116A at a location radially offset from the tip portion 124A of the tine member 120A to flip 20 (shown in FIG. 3) and/or spin 22 (shown in FIG. 3) the agitator 100 end-over-end responsive to the force 24 applied to the weighted ball portion 130A of the flip member 122A. It is contemplated that the agitator 100 be formed from a polymeric or a metallic material 132 (shown in FIG. 1). In accordance with certain examples the polymeric or the metallic material 132 that cooperates with the weighted ball portion 130A of the agitator 100 to limit damage to a cavity surface of the vessel body 104 and within the movement envelope of the agitator 100 defined within the cavity of the storage vessel 104.

The rod member 116A member connects the tine member 120A to the flip member 122A. In the illustrated example the rod member 116A is a first rod member 116A and the agitator includes a plurality of rod members, e.g., a second rod member 116B, a third rod member 116C, a fourth rod member 116D, and a fifth rod member E.

Each of the plurality of rod members are arranged along the axis 118, the second rod member 116B axially spaced from the first rod member 116A, the third rod member 116C axially spaced from the second rod member 116B, the fourth rod member 116D axially spaced from the third rod member 116C, and the fifth rod member 116E axially spaced from the fourth rod member 116D. Although a specific number of rod members are shown in the illustrated example, i.e., five (5) rod members, it is to be understood and appreciated that other implementations of the agitator 100 can have fewer than five (5) rod members or more than five (5) rod members.

The tine member 120A is arranged for displacing a portion of the fire suppressant dry particulate 14 (shown in FIG. 1) during the flip 20 (shown in FIG. 3) and/or the spin 22 (shown in FIG. 3) of the agitator 100. In the illustrated example the agitator 100 includes a plurality of tine members, e.g., the first tine member 120A, a second tine member 120B, a third tine member 120C, a fourth tine member 120D, a fifth tine member 120E, a sixth tine member 120F, a seventh tine member 120G, and an eighth tine member 120H.

One or more of the plurality of tine members is coplanar with and is arranged in a first plane 26 with first tine member 120A, e.g., the second tine member 120B, the third tine member 120C, and the fourth tine member 120D. One or more of the plurality of tine members is arranged in a second plane 28 orthogonal with the first tine member 120B, e.g., the fifth tine member 120E, the sixth tine member 120F, the seventh tine member 120G, and the eighth tine member 120H. As further illustrated in FIG. 2, the tine members are distributed asymmetrically about the axis 118, which allows mixing the fire suppressant dry particulate 16 (shown in FIG. 1) while limiting stability of the agitator 100. Although a specific number of tine members are shown in the illustrated example, i.e., eight (8) tine members, it is to be understood and appreciated that other implementations of the agitator 100 can have fewer than eight (8) tine members or more than eight (8) tine members. As will be appreciated by those of skill in the art in view of the present disclosure, the number of tine members included by the agitator is selected such that sufficient mixing occurs but not some many as to cause the agitation to rest within the vessel body. As will also be appreciated by those of skill in the art in view of the present disclosure, certain types of dry particulates may require agitators having a number of tine members differing from agitators employed with other types of dry particulates.

The flip member 122A is arranged on an end of the agitator 100 and includes the weighted ball portion 130A and the rod portion 128A. In certain examples the weighted ball portion 130A is spherical, which reduces (or eliminates entirely) likelihood of damage to the cavity surface of the wall 108 (shown in FIG. 1) of the vessel body 104 (shown in FIG. 1) otherwise attendant with the flip 20 (shown in FIG. 3) and/or the spin 22 (shown in FIG. 3) of the agitator 100. In accordance with certain embodiments the flip member 122A has a radial length that is greater the tine member 120A, limiting the magnitude of force 24 (shown in FIG. 3)

required to flip and/or spin 22 (shown in FIG. 3) the agitator 100 due to the associated cantilever arrangement of the weighted ball portion 130A.

In the illustrated example the flip member 122A is a first flip member 122A and agitator 100 includes a second flip member 122B, a third flip member 122C, and a fourth flip member 122D. The first flip member 122A and the second flip member 122B are both connected to the first rod member 116A. In this respect the first rod member 122A and the second rod member 122B are both arranged on an axially common first end 124 of the agitator 100 and the first rod member 116A couples the first flip member 122A and the second flip member 122B to the third flip member 122C and the fourth flip member 122D, e.g., through the other(s) of the plurality of rod members. Although a specific number of flip members are shown in the illustrated example, i.e., four (4) flip members, it is to be understood and appreciated that other implementations of the agitator 100 can have fewer than four (4) flip members or more than four (4) flip members. Advantageously, providing an orthogonal system having six (6) planes allows the system to be balanced when equal forces are exerted on the system in three (3) planes. The forces are asymmetric and in a different number of planes, then the system will be inherently unstable and seek to move until it can achieve a static rest condition, which can never be achieved by the nature of its construction.

The first flip member 122A is arranged in a common plane, e.g., the first plane 26, with the first tine member 120A. More specifically, the first flip member 122A, and none of the other of the plurality of flip members, is arranged in the first plane 26. In this respect the second flip member 122B is offset circumferentially about the axis 118 from the first flip member 122A by 90-degrees, the third flip member 122C is circumferentially offset about the axis 118 by 90-degrees, and fourth flip member 122D is offset circumferentially from the first flip member by 180-degrees. Offset each of the plurality of flip members by 90-degrees or 180-degrees from one of the plurality of flip members limits the stability of the agitator 100, reducing magnitude of the force 24 (shown in FIG. 3) required for the flip 20 (shown in FIG. 3) and/or the spin 22 (shown in FIG. 3) the agitator 100.

As also shown in FIG. 2, the first flip member 122A and the second flip member 122B are arranged on an axially common side 134 of the tine member 120A, and the third flip member 122C and the fourth flip member 122D are arranged axially on an opposite side 136 of the tine member 120A. Arranging the plurality of tine members on axially opposite sides of the agitator further limits the stability of the agitator 100, reducing magnitude of the force 24 (shown in FIG. 3) required to flip and/or spin 22 (shown in FIG. 3) the agitator 100. In certain examples the plurality of flip members is evenly distributed between axially opposite ends of the agitator 100, the plurality of flip members is evenly distributed about the axis 118 of the agitator 100, and the plurality of flip members are unevenly distributed about the axis 118 of the agitator 100 at the axially opposite ends of the agitator 100. Without being bound by a particulate theory applicant believes that this arrangement provide the metastable support arrangement 114 sufficient to limit the force 24 (shown in FIG. 3) required for the flip 20 (shown in FIG. 3) and/or the spin 22 (shown in FIG. 3) of the agitator to provide mixing in response to low-frequency vibration found in vehicles, e.g., the vehicle 10.

Figure 3:
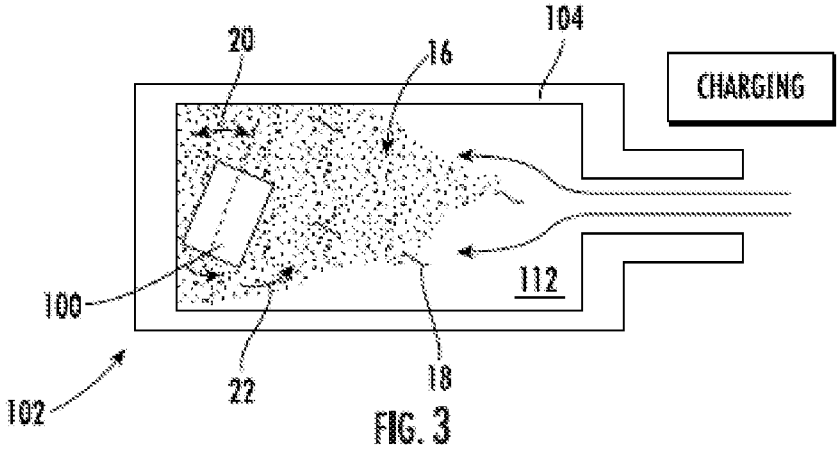
FIGS. 3-5 are schematic cross-sectional side views of the particulate storage vessel arrangement of FIG. 1, showing the agitator flipping end-over-end and rotating about multiple axes during charging of the particulate storage vessel arrangement, discharging of the particulate storage vessel arrangement, and in response to movement and vibration of the particulate storage vessel arrangement, respectively.
Figure 4:
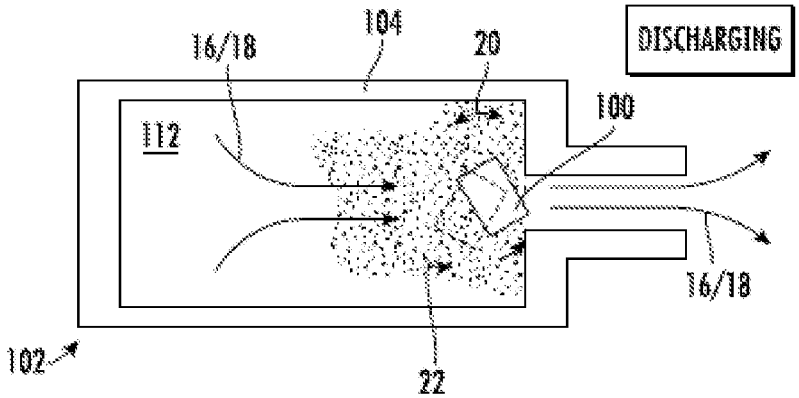
Figure 5:
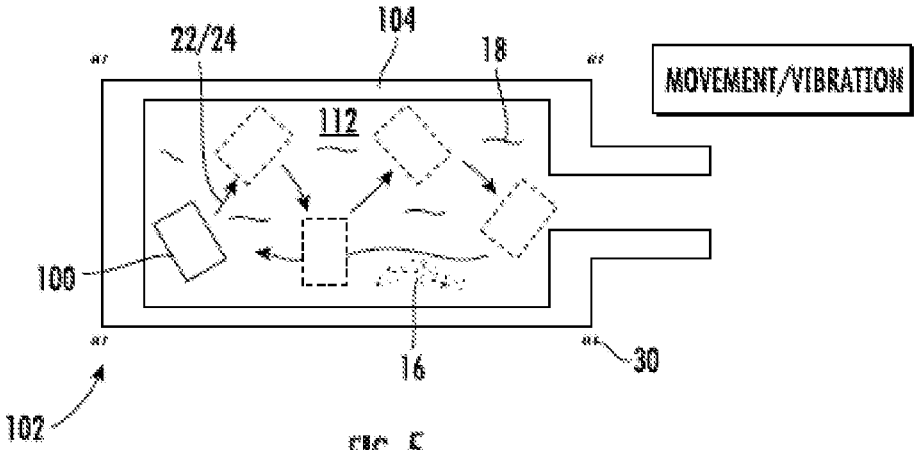

With reference to FIGS. 3-5, the particulate storage vessel arrangement 102 is shown during charging (FIG. 3), discharge (FIG. 4), and responding to movement and/or vibration (FIG. 5). As shown in FIG. 3, cooperation of the metastable support arrangement 114 (shown in FIG. 1) and the force 24 (shown in FIG. 2) associated with charging the particulate storage vessel arrangement 102 with a charging flow of the fire suppressant dry particulate causes the agitator 100 to flip 20 and/or spin 22 within the cavity 112 of the vessel body 104. This mixes the fire suppressant particulate 16 and prevents the load associated with the motive gas 18 from packing the fire suppressant dry particulate 16 against cavity surfaces of the vessel body 104.

As shown in FIG. 4, cooperation of the metastable support arrangement 114 (shown in FIG. 1) and the force 24 (shown in FIG. 2) associated with discharge the particulate storage vessel arrangement 102 with a discharge flow of fire suppressant dry particulate causes the agitator 100 to flip 20 and/or spin 22 within the cavity 112 of the vessel body 104. This mixes the fire suppressant particulate 16 during discharge events by preventing packed fire suppressant dry particulate 16 from occluding the valve 106 (shown in FIG. 1).

As shown in FIG. 5, cooperation of the metastable support arrangement 114 (shown in FIG. 1) and the force 24 (shown in FIG. 2) associated with movement and/or vibration 30 communicated to the particulate storage vessel arrangement 102, e.g., by the vehicle 10 (shown in FIG. 1), cause the agitator 100 to flip 20 and/or spin 22 within the cavity 112 of the vessel body 104. This mixes the fire suppressant particulate 16 between charging events (e.g., as shown in FIG. 3) and discharge events (e.g., as shown in FIG. 4).

Figure 6:
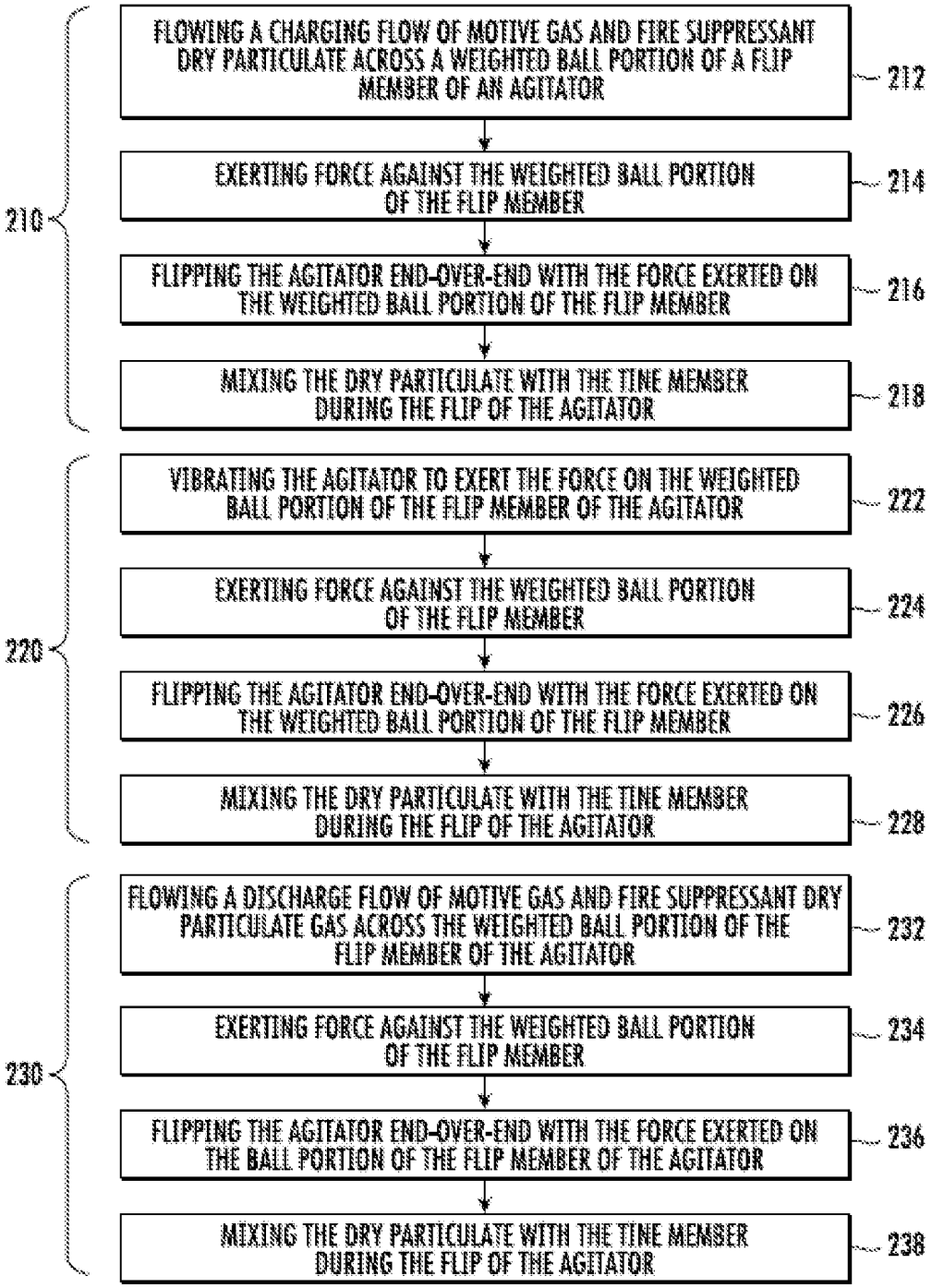
FIG. 6 is process flow diagram of a method of agitating a dry particulate contained within the cavity of a particulate storage vessel arrangement, showing operations of the method according to an illustrative and non-limiting example of the method.

With reference to FIG. 6, a method 200 of agitating dry particulate contained within a storage vessel, e.g., the fire suppressant dry particulate 14 (shown in FIG. 1) contained within the vessel body 104 (shown in FIG. 1), is shown. The method 200 generally includes moving the vessel body; altering inertial and/or gravitational forces on an agitator, e.g., the agitator 100 (shown in FIG. 1) positioned within the vessel, the agitator having a weighted portion attached to a stirring portion; moving the weighted portion with the altering of inertial and/or gravitational forces; and moving the stirring portion through the particulate in response to the moving of the weighted portion. It is contemplated that these operations occur during one or more of mixing the fire suppressant dry particulate during charging of the storage vessel, as shown with bracket 210; mixing the fire suppressant dry particulate during between charging and discharging of the fire suppressant dry particulate, as shown with bracket 220; and/or includes mixing the fire suppressant dry particulate during discharging of the storage vessel, as shown with bracket 230.

As shown with box 212, charging the storage vessel with the fire suppressant dry particulate includes flowing a charging flow of motive gas, e.g., the motive gas 18, and fire suppressant dry particulate into the storage vessel. The charging flow exerts force against the weighted ball portion of the flip member, e.g., the force 24 (shown in FIG. 2) against the weighted ball portion 130 (shown in FIG. 2) of the flip member 122 (shown in FIG. 2), as shown with box 214. The force flips the agitator end-over-end, e.g., the flip 20 (shown in FIG. 3) or the spin 22 (shown in FIG. 3) of the agitator 100 (shown in FIG. 1), as shown with box 216. As the agitator flips end-over-end a tine member of the agitator, e.g., the tine member 120 (shown in FIG. 2), mixes the fire suppressant dry particulate, as shown with box 218. Mixing (or agitating) the fire suppressant dry particulate during charging of the storage vessel allows the fire suppressant dry particulate to issue relatively freely from the valve 106 (shown in FIG. 1 in comparison to packed dry particulate of identical composition), limiting the amount of motive gas required per unit mass of fire suppressant dry particulate As shown with box 222, vibrating (and/or moving) the storage vessel also mixes the fire suppressant dry particulate contained within the storage vessel. In this respect vibrating and/or moving the storage vessel exerts force against the weighted ball portion of the flip member, e.g., the force 24 (shown in FIG. 2) against the weighted ball portion 130 (shown in FIG. 2) of the flip member 122 (shown in FIG. 2), as shown with box 224. The force flips the agitator end-over-end, e.g., the flip 20 (shown in FIG. 3) or the spin 22 (shown in FIG. 3) of the agitator 100 (shown in FIG. 1), as shown with box 226. As the agitator flips end-over-end a tine member of the agitator, e.g., the tine member 120 (shown in FIG. 2), mixes the fire suppressant dry particulate, as shown with box 228. Mixing (or agitating) the fire suppressant dry particulate using vibration and/movement of the storage vessel allows the fire suppressant dry particulate to issue freely from the valve 106 (shown in FIG. 1) in comparison to packed dry particulate of identical composition, limiting the amount of motive gas required per unit mass of fire suppressant dry particulate.

As shown with box 232, discharging the storage vessel also mixes the fire suppressant dry particulate contained within the storage vessel. Specifically, upon actuation a discharge flow of motive gas and fire suppressant dry particulate flows across the weighted ball portion of the flip member, e.g., the force 24 (shown in FIG. 2) against the weighted ball portion 130 (shown in FIG. 2) of the flip member 122 (shown in FIG. 2), as shown with box 234. The force flips the agitator end-over-end, e.g., the flip 20 (shown in FIG. 3) or the spin 22 (shown in FIG. 3) of the agitator 100 (shown in FIG. 1), as shown with box 236. As the agitator flips end-over-end a tine member of the agitator, e.g., the tine member 120 (shown in FIG. 2), mixes the fire suppressant dry particulate, as shown with box 238. Mixing (or agitating) the fire suppressant dry particulate during discharge of the storage vessel allows the fire suppressant dry particulate to issue relatively freely from the valve 106 (shown in FIG. 1 in comparison to packed dry particulate of identical composition), limiting the amount of motive gas required per unit mass of fire suppressant dry particulate.

Dry particulates, such as fire suppressant dry particulates contained within fire suppression cylinders, can experience compacting during filling and settling of the dry particulate over time. Specifically, if the storage vessel is not regulated then there can be compacting of the dry particulate due to the force loads associated with driving the dry particulate against the wall of the storage vessel opposite the inlet port of the storage vessel. Further, settling can occur during the storage interval between charging and discharging the storage vessel. While such compaction can be managed in the case of fire suppression cylinders subject to periodic inspection, such as by upending the storage vessel and hand-tapping the storage vessel to dislodge compacted dry particulate, such inspections require time and planning in order to ensure reliability of the fire suppression cylinder.

In examples described here a multi-axis dry chemical mixer device (agitator) is provided for support in a storage vessel in a metastable arrangement. For example, in certain examples the agitator has one or more flip member with a weighted ball portion, one or more tine member, and one or more rod member. The one or more weighted ball portion is connected to the one or more tine member by the one or more rod portion such that, when force is exerted against the weighted ball portions, the agitator flips end-over-end. The end-over-end flip displaces the one or more tine member, the one or more tine member in turn agitating dry lubricant in mechanical communication with the one or more tine member.

In certain examples the force exerted on the one or more weighted ball portion can be communicated during charging of the storage vessel with dry lubricant. In this respect, during charging, the agitator spins on its unstable axes within the storage vessel (e.g., at the base of the storage vessel opposite the storage vessel port) to prevent packing of the dry lubricant. The spinning of the agitator limits (or prevents entirely) packing of the dry lubricant against the cavity surface of the storage vessel due to deceleration of the dry lubricant upon impacting the cavity surface of the storage vessel.

In accordance with certain examples the force exerted on the one or more weighted ball portion can be communicated during discharging of dry lubricant from the storage vessel. For example, during discharging, the agitator spins on its unstable axes the agitator spins on its unstable axes within the storage vessel (e.g., at proximate the storage vessel port). The spins prevent blockage of the port and/or homogenization of the dry lubricant issued from the port through mechanical communication between the one or more tine member and dry lubricant communicated to the port during discharging.

It is also contemplated that, in accordance with certain embodiments, the agitator mixes the dry lubricant contained within the storage vessel between charging and discharging of the storage vessel. In this respect it is contemplated that force exerted on the one or more weighted ball due to motion of the storage vessel, e.g., due to movement and/or vibration associated with motion of a vehicle carrying the storage vessel, move, rotate and/or spin the agitator. The movement, rotation and/or spinning of the agitator continuously mixes the dry lubricant responsive to the motion of the vehicle due to mechanical communication of the dry lubricant with the tine members—reducing (or eliminating entirely) the tendency of the dry lubricant to compact over time.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. An agitator for disposition within a cavity of a vessel body containing a particulate, the agitator comprising:

a stirring portion having a rod member and a plurality of tine members extending radially from the rod member, the plurality of tine members being coplanar within a first plane arranged parallel to an axis of the rod member; and a flip member arranged at an end of the agitator, the flip member extending radially from the rod member and having a weighted ball portion connected to the rod member by a rod portion, wherein the weighted ball portion is radially offset from the tine member;

wherein the agitator is positionable relative to the vessel body to move the stirring portion through the particulate in response to movement of the weighted portion in response to gravitational and/or inertial forces acting on the weighted portion due to movement of the vessel body.

2. The agitator as recited in claim 1, wherein the rod member defines an axis;

wherein the tine member has a base portion and a tip portion, the base portion connecting the tip portion with the rod member; and wherein the rod portion connects the weighted ball portion with the rod member at a location radially offset from the tip portion of the tine member to flip the agitator end-over-end responsive to force applied to the weighted ball portion of the flip member.

3. The agitator of claim 2, wherein the rod member connects the tine member to the flip member, the flip member axially offset from the tine member.

4. The agitator of claim 2, wherein the rod member is a first rod member and further comprising at least one second rod member, the second rod member arranged along the axis and connected to the first rod member by the tine member.

5. The agitator of claim 2, wherein the plurality of tine members is a first tine member and a second tine member, the second tine member being connected to the rod member.

6. The agitator of claim 5, further comprising another tine member, wherein the another tine member is arranged in a plane orthogonal relative to the first tine member.

7. The agitator of claim 2, wherein the flip member is a first flip member and further comprising a second flip member connected to the rod member.

8. The agitator of claim 7, wherein the first flip member and the tine member are arranged in a common plane, and wherein the second flip member is offset from the first flip member 90-degrees or 180-degrees.

9. The agitator of claim 7, wherein the first flip member and the second flip member are arranged at a same side of the tine member.

10. The agitator of claim 7, wherein the first flip member and the second flip member are arranged at opposite sides of the tine member.

11. The agitator of claim 2, wherein the rod member is one of a plurality of rod members axially spaced from one another along the axis, wherein the tine member is one of a plurality of tine members connected to the rod members, and wherein the flip member is one of a plurality of flip members circumferentially offset from one another about the axis.

12. The agitator of claim 1, wherein the flip member is one of a plurality of flip members, wherein the plurality of flip members are evenly distributed between axially opposite ends of the agitator, wherein the plurality of flip members are evenly distributed about the axis, and wherein the plurality of flip members are unevenly distributed radially about the axis.

13. The agitator of claim 1, wherein the agitator is formed from a polymeric or a metallic material.

* * * * *